US006286721B1

(12) United States Patent
Pellegrini

(10) Patent No.: US 6,286,721 B1
(45) Date of Patent: Sep. 11, 2001

(54) MODULAR MANIFOLD SYSTEM FOR POST-MIX AND PRE-MIX BEVERAGES DISPENSERS

(76) Inventor: Enrica Pellegrini, Via Valdinievole, 26, I-50127 Florence (IT)

( * ) Notice: Subject to any disclaimer, the term of this patent is extended or adjusted under 35 U.S.C. 154(b) by 0 days.

(21) Appl. No.: 09/581,733

(22) PCT Filed: Dec. 17, 1998

(86) PCT No.: PCT/IT98/00368

§ 371 Date: Sep. 29, 2000

§ 102(e) Date: Sep. 29, 2000

(87) PCT Pub. No.: WO99/31007

PCT Pub. Date: Jun. 24, 1999

(30) Foreign Application Priority Data

Dec. 18, 1997 (IT) ..... FI97A0275

(51) Int. Cl.[7] ..... B67D 5/56

(52) U.S. Cl. ..... 222/129.1; 222/146.6; 137/340; 137/884

(58) Field of Search ..... 222/129.1, 129.4, 222/146.6; 137/269, 340, 884; 251/357

(56) References Cited

U.S. PATENT DOCUMENTS 3,347,421 10/1967 Yingst .
3,710,981 * 1/1973 Arzberger et al. ..... 222/129.1
3,902,636 * 9/1975 Zilk ..... 222/129.1
4,592,490 * 6/1986 McMichael ..... 222/129.1
5,685,458 11/1997 Durham et al. .
5,884,813 * 3/1999 Bordonaro et al. ..... 222/129.1
5,931,348 * 8/1999 Guadalupi ..... 222/129.1
5,984,142 * 11/1999 Castaldi ..... 222/129.1

FOREIGN PATENT DOCUMENTS 0 837 029A 4/1998 (EP) .

* cited by examiner

*Primary Examiner*—Kevin Shaver
*Assistant Examiner*—Melvin A. Cartagena
(74) *Attorney, Agent, or Firm*—Harrison & Egbert

(57) ABSTRACT

A modular manifold system for distribution of post-mix and pre-mix beverages, whose peculiarity includes several modular units connected to each other, of which only one is connected to the external devices for supplying of still water and carbonated water. Each unit is able to supply, by choice of the user, or a dispensing pre-mix tap, or a post-mix tap with still water, or a post-mix tap with carbonated water or two post-mix taps with still water or carbonated water, allowing furthermore to modify the percentage of carbon dioxide diluted in the carbonated water.

14 Claims, 7 Drawing Sheets

MODULAR MANIFOLD SYSTEM FOR POST-MIX AND PRE-MIX BEVERAGES DISPENSERS

BACKGROUND OF THE INVENTION

1. Field of the Invention

The present invention relates to counter apparatuses for beverages dispensing and in particular to a modulated manifold system for distribution of post-mix and pre-mix beverages.

2. Description of Related Art

The word manifold system is used in the field of post-mix and pre-mix beverages distribution to indicate the part of the distributing apparatus comprised between the refrigerating device and the beverages dispensing front part and having the aim of feeding the taps of the dispensing front part with pre-mix beverages, syrups, still water and carbonated water necessary to obtain post-mix beverages.

The word post-mix beverage indicates beverages prepared by the producer as syrup or concentrated beverage which need to be diluted with still water or carbonated water before being dispensed. The word pre-mix beverage indicates beverage to be dispensed as prepared by the producer.

In the prior art manifold systems are constituted by units having as inlet the pipelines coming from the refrigerating system and carrying beverages, still water, carbonated water for diluting post-mix beverages, and the fluid (generally water) used for the cooling of the system. The manifold system depends on the type of dispensing front part to which the system has to be connected and in particular from the number and types of taps, such as post-mix taps with still water, post-mix with carbonated water and pre-mix, which such front part includes.

The inconveniences of the modular manifold systems according to such prior art are basically due to the necessity to manufacture different types of units according to the number and types of the taps disposed on the dispensing front part. Furthermore once the apparatus has been mounted it is almost impossible to modify the types of taps on the dispensing front part.

A further problem shown by the known systems is the maintenance which is difficult because, almost always, it is necessary to disassemble the whole dispensing front part even when the problem concerns only a single line.

The aim of the present invention is a modular manifold system which obviates the necessity of manufacturing different types of units according to the number and types of taps disposed on the dispensing front part.

Another aim is to allow, once the apparatus has been mounted, changing of one number and type of the taps on the dispensing front part.

A further aim is to allow the mixing of still water and carbonated water inside the same system to obtain a diluting water of the post-mix beverages with a gassing more suitable to the different types of beverages.

Another aim is to facilitate the assembly maneuvers and maintenance services.

Still another aim is to obtain a modular manifold system of easy and inexpensive manufacture without suing specialized workpeople or sophisticated technologies.

These and further aims are achieved by the modular manifold system according to the invention.

BRIEF SUMMARY OF THE INVENTION

The modular manifold system of the present invention comprises: at least two units connected to each other. Inside each unit two transversal channels are placed, such channels being suitable for transporting the pre-mix beverages and the syrups for the post-mix beverages, such channels being outside communicating in order to be connected to outside feeding and dispensing three longitudinal channels suitable for transporting water, carbonated water and the refrigerating fluid, and being said modular channels adjacent and communicating with each other. Each unit also compresses three transversal channels outletting on said three longitudinal channels and being outside communicating in order to be connected to outside feeding devices. Each unit comprises a regulating means which allows choosing between water or carbonated water dilutes the syrup, and furthermore allows the regulation of the inflow of the two types of water to a mixing chamber placed inside the same unit and communicating outside through suitable channels. Each unit is further provided with gate valves which allow the opening and the closing of the channels suitable for transporting the pre-mix beverages and the syrups.

The present invention allows, because of its modular shape, feeding for a number of dispensing taps which can be freely varied. Thanks to the inner pipeline, to the regulating means and to the gate valves present on each unit, it is possible to vary the type of dispensing taps fed by the single unit. Furthermore it is possible, by means of the mixing chamber and of the regulating means placed on each unit, to mix still water and carbonated water in order to freely vary the gassing of the post-mix beverage supplied by the single unit.

BRIEF DESCRIPTION OF THE SEVERAL VIEWS OF THE DRAWINGS

Further characteristics and advantages of the invention will more clearly arise from the following description, made by way of example not limitative, with reference to the enclosed drawings.

DETAILED DESCRIPTION OF THE INVENTION

Figures 1, 1A:
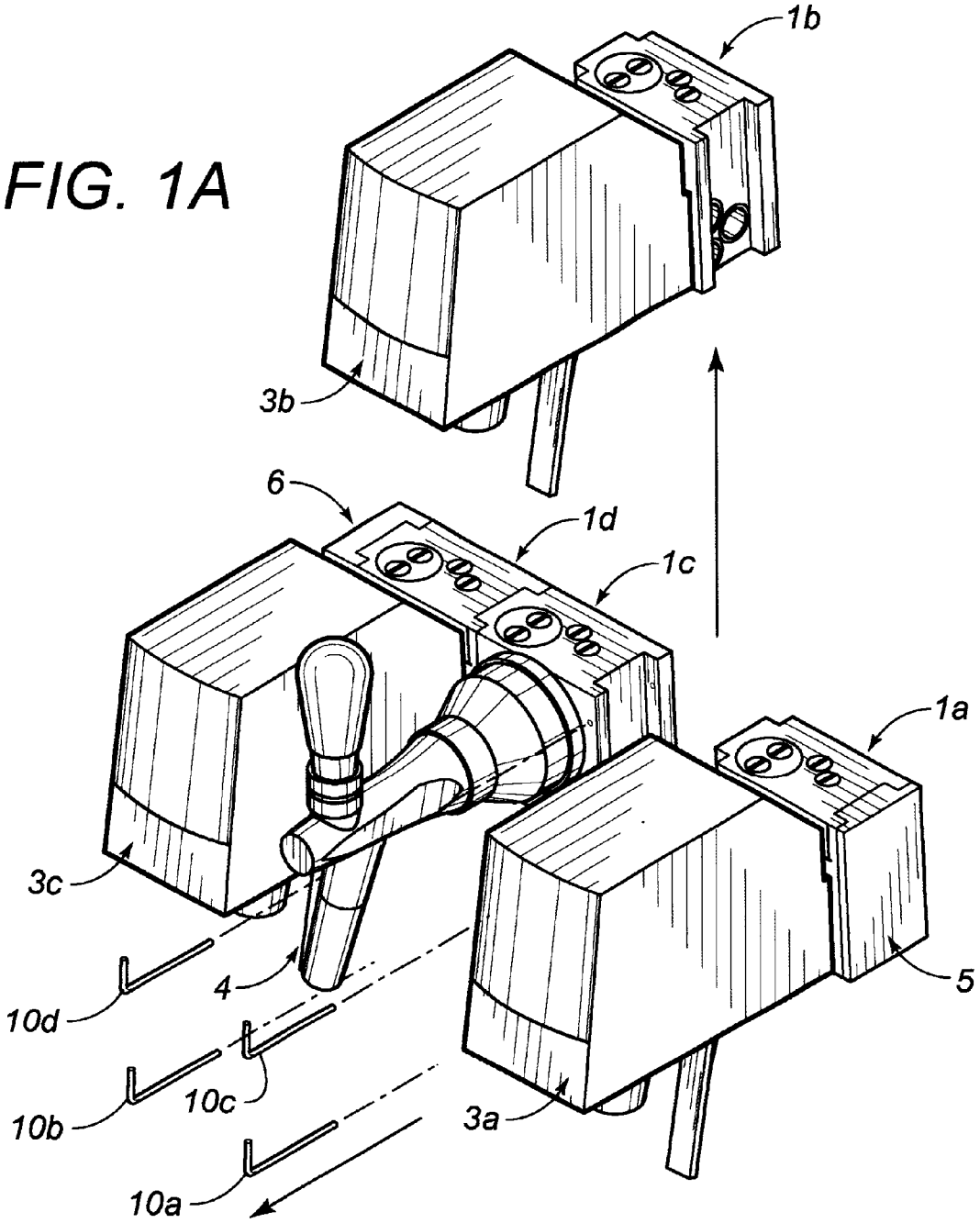
FIG. 1 shows an overall view of the manifold system with the dispensing front part.
FIG. 1*a* shows disassembly of an intermediate unit.
Figure 2:
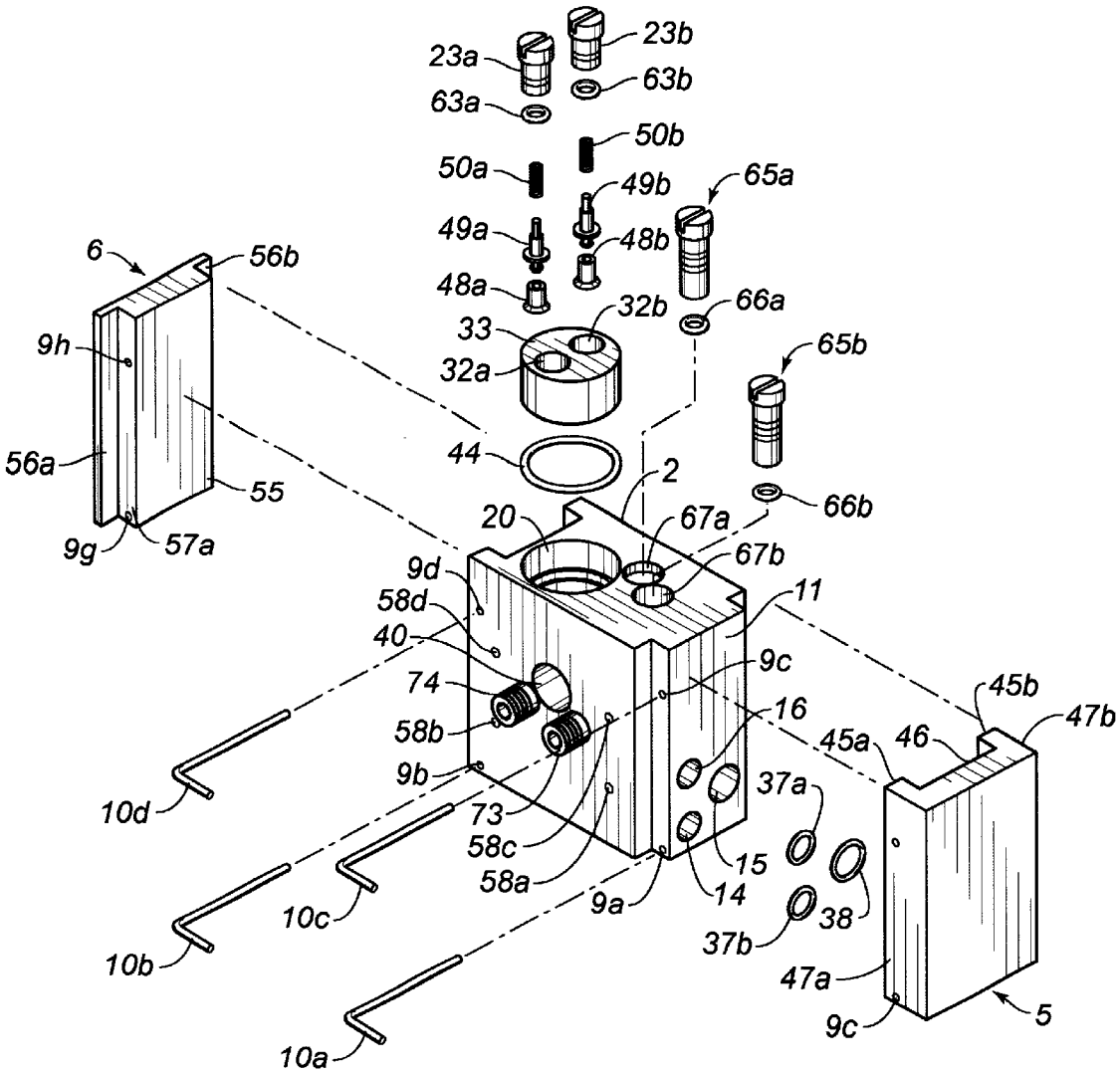
FIG. 2 shows an exploded view of a single unit and of the side closing parts of the system.
Figure 3:
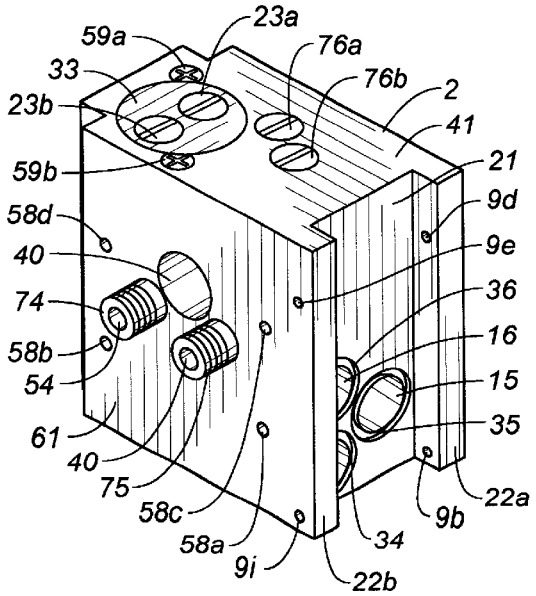
FIG. 3 and FIG. 4 are an sectional views of a single unit.
Figure 4:
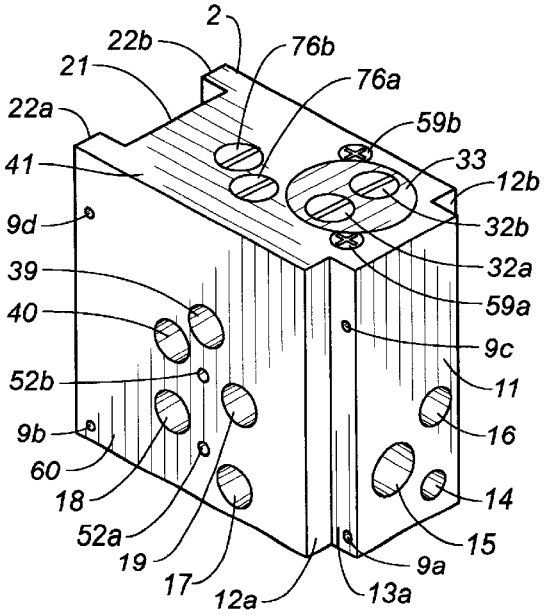
Figure 5:
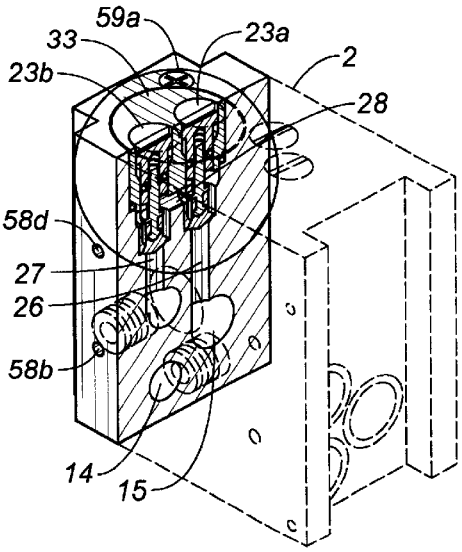
FIG. 5 is a sectional view, through a transversal section of the unit, of the mixing chamber, of its feeding channels, of the regulating elements and of the nonreturn valves.
Figure 6:
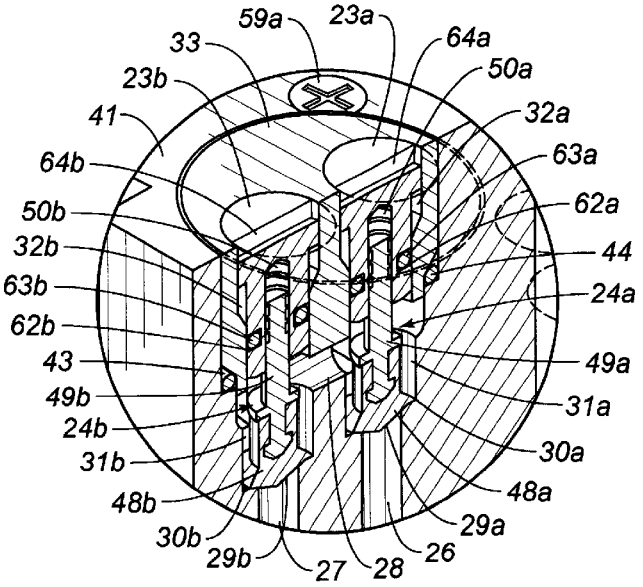
FIG. 6 is an enlarged view of the regulating elements and of the nonreturn valves shown in FIG. 5.
Figure 7:
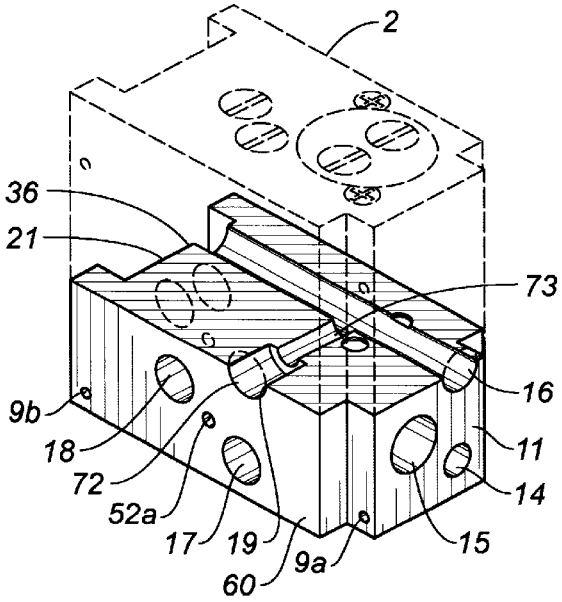
FIG. 7, FIG. 8 and FIG. 9 are sectional views, through longitudinal sections of the unit, of the longitudinal and transversal channels transport the water, carbonated water, and the refrigerating fluid.
Figure 8:
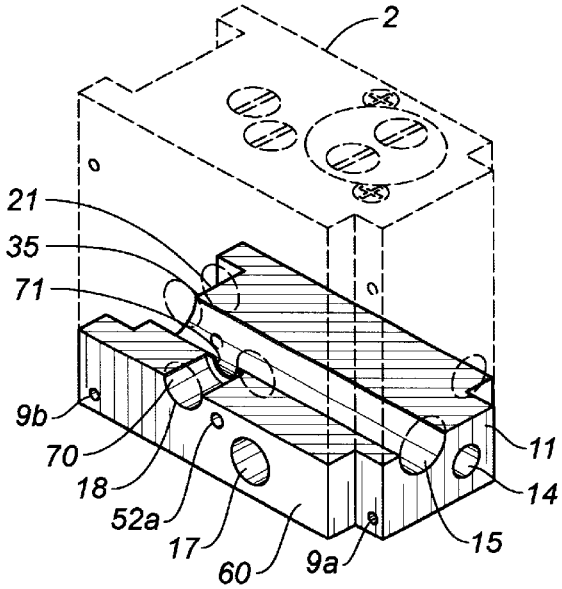
Figure 9:
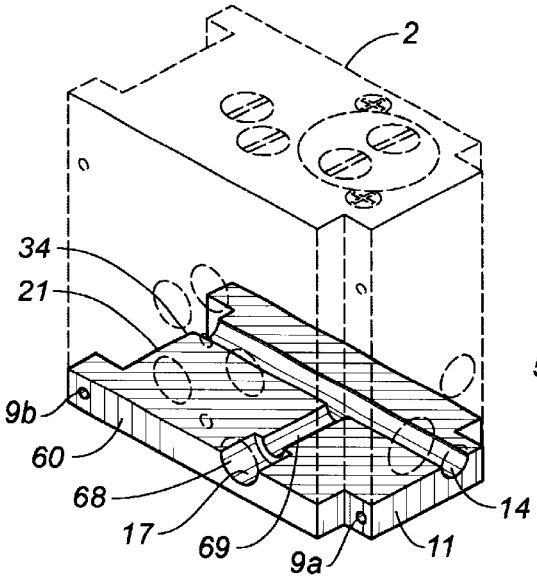
Figure 10:
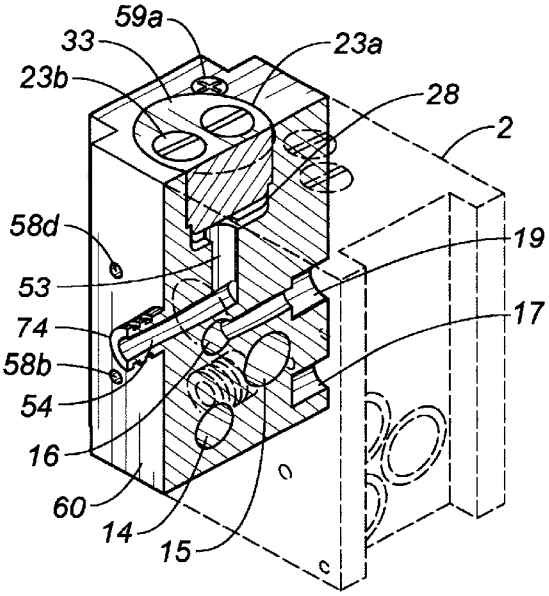
FIG. 10 is a sectional view, through transversal sections of the unit, of the mixing chamber, of the closing element of the same and of its outlet.
Figure 11:
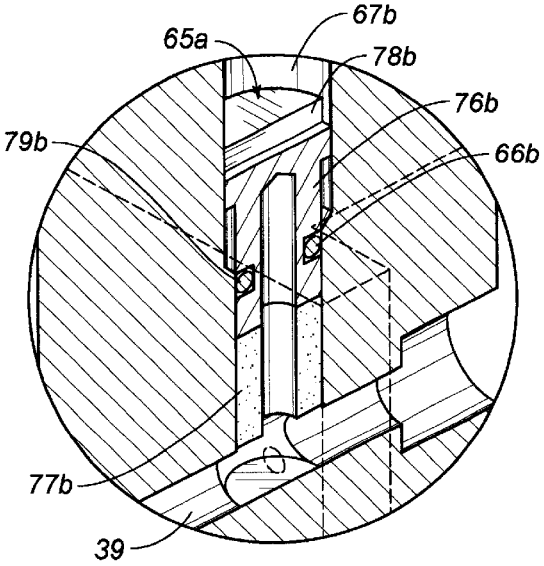
FIG. 11 and FIG. 12 are an enlarged views of the gate valves fit for closing the feeding channels of the beverages.
Figure 13:
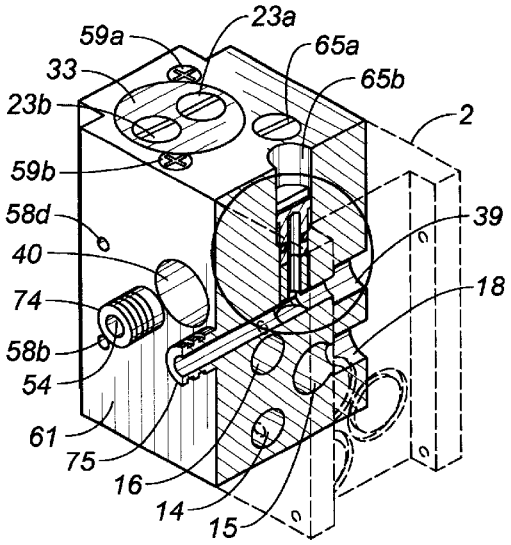
FIG. 13 and FIG. 14 are sectional views, through transversal sections of the unit, of the feeding channels of the beverages and of the gate valves.
Figure 12:
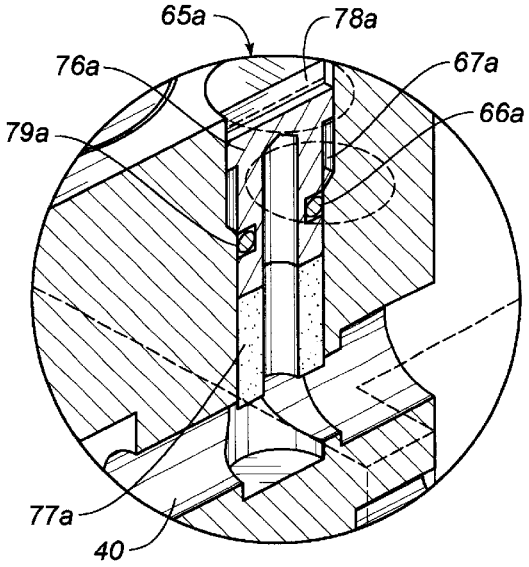
Figure 14:
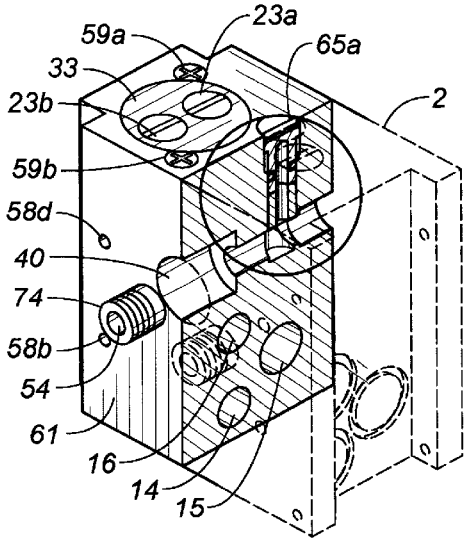

A modular manifold system, as the embodiment shown in FIG. 1, has four modular units 1*a*, 1*b*, 1*c* and 1*d*. Each body 2 having substantially a parallelopipe shape, having on the transversal opposite faces the surface 11 which is raised according to surfaces 12*a* and 12*b*, the surface 21, the surface 22*a* and the surface 22*b* raised according to the surface 21. These surfaces allow the joint fixed connection between two modular units. The surface 13*a* has the holes 9*a* and 9*c*, similar holes (not shown in figure) are disposed on the surface 13*b*. The surface 60 has the holes 9*b* and 9*d*, whereas the surface 61 has the holes 9*i* and 9*l*. the holes 9*b*, 9*d*, 9*i* and 9*l* are through holes. The holes 9*a*, 9*b*, 9*c* and 9*d* allow through the passing pins 10*a*, 10*b*, 10*c* and 19*d*, which are L-shaped to facilitate the grip, to fasten the joint fixed connection between two modular units. As shown in FIG. 1 and FIG. 2 at the terminal side parts of the system of modular units the two terminal parts 5 and 6 are placed. The part 5 has the surfaces 45*a*, 45*b* and 46 which are counter-shaped according to surfaces 12*a*, 12*b* and 11; the part 6 has the surfaces 56*a*, 56*b* and 55 which are countershaped according to surfaces 22*a*, 22*b* and 21. The surface 46*a* has the holes 9*e* and 9*f*. Similar holes (not shown in figure) are present on the surface 47*b*. The surface 57*a* has holes 9*g* and 9*h*. Similar holes (not shown in figure) are on surface 57*b*. These holes are used to fix to the body 2 the terminal parts 5 and 6 through the suitable passing pins working as a connector. As shown in FIGS. 7, 8, 9 the body 2 is longitudinally crossed by three channels having circular section 14, 15 and 16, wherein the channel 14 is the channel transporting blow-by water for the cooling, the channel 15 transporting the water and the channel 16 transporting the carbonated water. Such channels outlet on the opposite surfaces 11 and 21. On the surface 21 corresponding to said channels three annular grooves 34, 35 and 36 are carried out such that the same channels 14, 15 and 16 project out with a cylindrical portion, allowing in such a way the connection among the corresponding channels 14, 15 and 16 of two jointed modular units. The seal of the fluids passing through the channels and consequently through the modular units, is obtained through the O_rings 37*a*, 37*b* and 38. The outside feeding of the longitudinal channels 14, 15 and 16 is obtained through the transversal channels 17, 18 and 19, the channels outletting on the rear surface 60. They are fed by external pipelines connected to the body 2 through the holes 52*a* and 52*b*. The channels 14, 15 and 16 of the units at the terminal side parts of the system have the terminal portions placed in contact outside respectively with the parts 5 and 6 closed through a suitable cap (not shown in figure). The same condition is for the feeding channels 17, 18 and 19 of the intermediate units 1*b* and 1*c* of the embodiment shown in FIG. 1 which are closed with suitable cap (not shown in figure). The channel 17 is constituted by two cylindrical portions 68 and 69 having circular section of different diameters. The channel 18 is constituted by two cylindrical portions 70 and 71 having circular section of different diameter and the channel 19 is constituted by two cylindrical portions 72 and 73 having circular section of different diameter, the portions having the larger diameter 68, 70 and 72 outletting on the surface 60 and having the same length, the portions having the minor diameter 69, 71 and 73 outletting on the corresponding longitudinal channels. The length of these second portions depends on the distance of the axis of the longitudinal channel from the surface 60. The longitudinal channels 15 and 16, as shown in FIG. 5, can feed through the vertical cylindrical channels 26 and 27 having a circular mixing chamber 28. The inflow of the still water and of the carbonated water into the mixing chamber 28 is controlled through the regulating means 23*a* and 23*b* and the nonreturn valves 24*a* and 24*b*. The nonreturn valves are constituted by the spear valves 48*a* and 48*b* made in gummy resin, by the stems 49*a* and 49*b* and by the springs 50*a* and 50*b*. the spear valves 48*a* and 48*b* are constituted by a cylindrical drilled portion which houses a terminal part of the stems 49*a* and 49*b*, and by a truncated-core portion. The spear valves rest on the beating annular surfaces 30*a* and 30*b*. Through the surfaces 29*a* and 29*b* having an overturned cone shape, they can move axially inside the chambers 31*a* and 31*b* having a cylindrical shape with circular section. The shape of the spear valves 48*a* and 48*b* allows that the possible presence of fluid in the chambers 31*a* and 31*b* coming from the mixing chamber 28 squash the same spear valves on the surfaces 30*a* and 30*b* preventing the passage of the fluid from the chamber 28 to the vertical feeding channels 26 and 27. A portion of the stems 49*a* and 49*b* and the springs 50*a* and 50*b* are housed inside the regulating means 23*a* and 23*b*. The means 23*a* and 23*b* have the annular grooves 62*a* and 62*b* inside which the O_rings 63*a* and 63*b* are housed. Such regulating means can move inside the chambers 32*a* and 32*b*. Both the regulating means and the chambers 32*a* and 32*b* have threaded surfaces (not shown in figure) which allow the axial movement of the same elements. The chambers 32*a* and 32*b* are carried out inside the cap 33 of the mixing chamber 28. The terminal portions of the regulating means 23*a* and 23*b* facing the superior surface 41 of the body 2 have the diametrical grooves 64*a* and 64*b* with which it is possible to vary the axial position of the same elements inside the chambers 32*a* and 32*b*. Such movement causes the changing of position of the spear valves 48*a* and 48*b*. The bigger the displacement downwards of the means 23*a* and 23*b*, then it is minor for the possibility of the spear valves to disjoin from the supporting surfaces 30*a* and 30*b*. Obviously the extreme condition is the closing of the feeding channels 26 and 27 of the mixing chamber 28. The cap 33 of the mixing chamber 28 has a cylindrical shape and it is housed in the chamber 20. It has an almost circular section and it is constrained to the body 2 through the screws 59*a* and 59*b*, in order to allow the seal of the chamber 28 in the annular groove 43 of the cap 33 of the O_ring 44 is inserted. The mixing chamber 28 is connected through the vertical channel 53 having an elliptical section, to the transversal channel 54, such channel having a circular section projecting out from the body 2 with a cylindrical portion 74 housing the set as for possible sealing O_rings for the connection with the outside dispensing devices. The body 2 is transversally crossed by the channels 39 and 40 shown in FIG. 13 and 14. Beverages come to these channels, in particular the syrup arrives to channel 39, whereas to channel 40 a syrup or a pre-mixed beverage can come. The channel 39 has a terminal portion 75 which comes out from the body 2 housing the seats for possible sealing O_rings for the connection with the outside dispensing devices. The channels 39 and 40 can be closed through the gate valves 65*a* and 65*b* constituted by the caps 76*a* and 76*b* and by the drilled cylindrical elements 77*a* and 77*b* made in gummy resin, connected to the caps 76*a* and 76*b* through a pivot (not shown in figure). The gate valves 65*a* and 65*b* move inside the chambers 67*a* and 67*b*. Both the gate valves and the chambers have threaded surfaces (not shown in figure) to allow the axial movement of the gate valves. The axial position is controlled using the diametrical grooves 78*a* and 78*b* disposed at the superior terminal portion of the caps 76*a* and 76*b*. The axial movement of the gate valves 65*a* and 65*b* causes the opening or the closing of the transversal channels 39 and 40. The seal is obtained through the O_rings 66*a* and 66*b* carried by the caps 76*a* and 76*b* in the annular grooves 79*a* and 79*b*.

Figure 15:
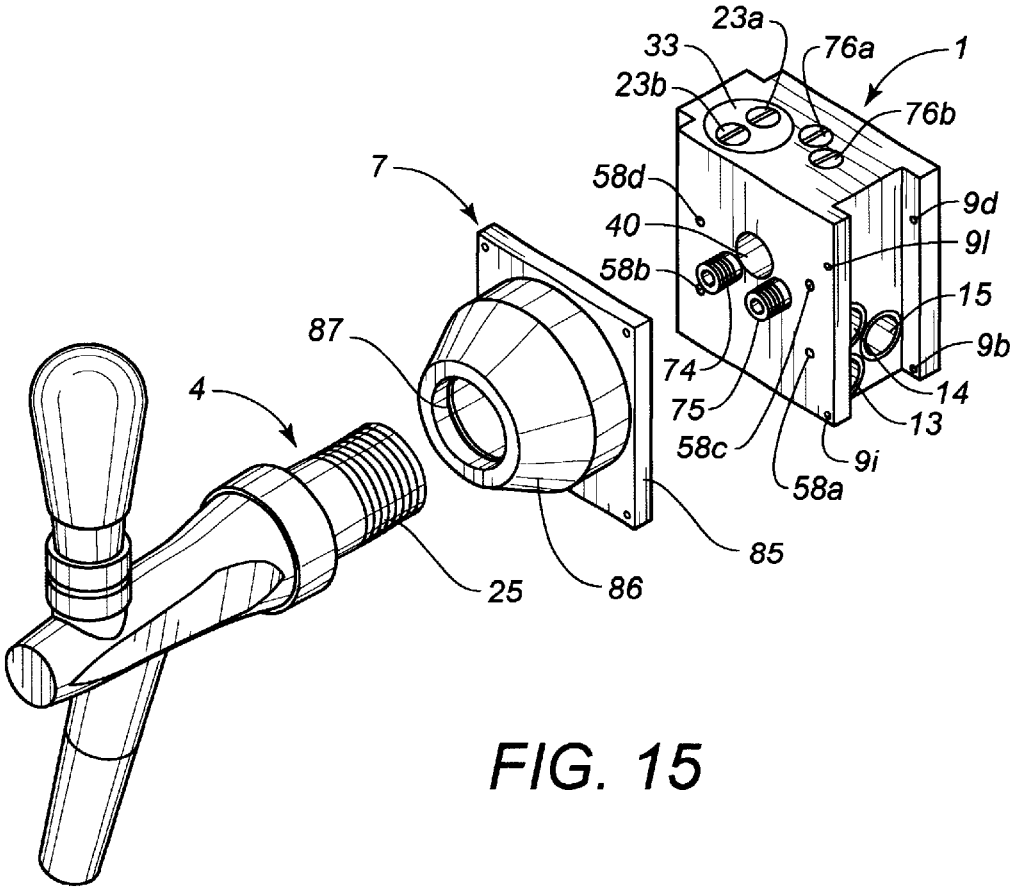
FIG. 15 shows the use of a single unit for feeding two taps with post-mix beverages.

Each described modular unit can be used to supply a pre-mix tap, in such case the transversal channel 39 will be closed using the gate valve 65*b* and the transversal channel 54 using the regulating means 23*a* and 23*b* in order to close the vertical channels 26 and 27. Furthermore, the adapter 7 is inserted as shown in FIG. 15. The adapted 7 is comprised of drilled pate 85 having a drilled truncated-cone position 86 presenting the thread 87 in order to allow the connection with the rear threaded portion 25 of the tap 4.

Figure 16:
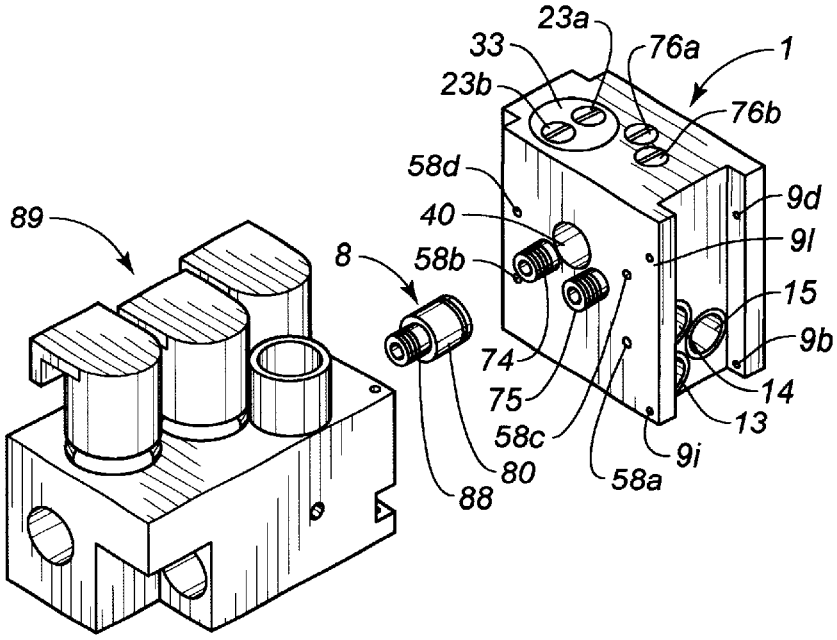
FIG. 16 shows the use of an unit for feeding a tap with pre-mix beverage.

The unit can as alternative be used to supply one or two taps for post-mix beverages. In the first case only the transversal channel 39 is fed and the transversal channel 40 is closed through the gate valve 65*a*. In the second case the transversal channels 32 and 40 are fed and the outlet of the channel 40 is modified through the adapter 8, shown in FIG. 16. The adapted 8 comprises two cylindrical portions 80 and 88, of which the portion 80 having a larger diameter is housed in the channel 40, and the portion 88 having a smaller projects out from the body 2 in order to be connected to the dispensing front part. In FIG. 16, it is further shown a tap 89 suitable to the dispensing of two post-mix beverages.

It is possible to adapt the system to any dispensing front part combining opportunely the several units, making the system easy to change.

Figure 17:
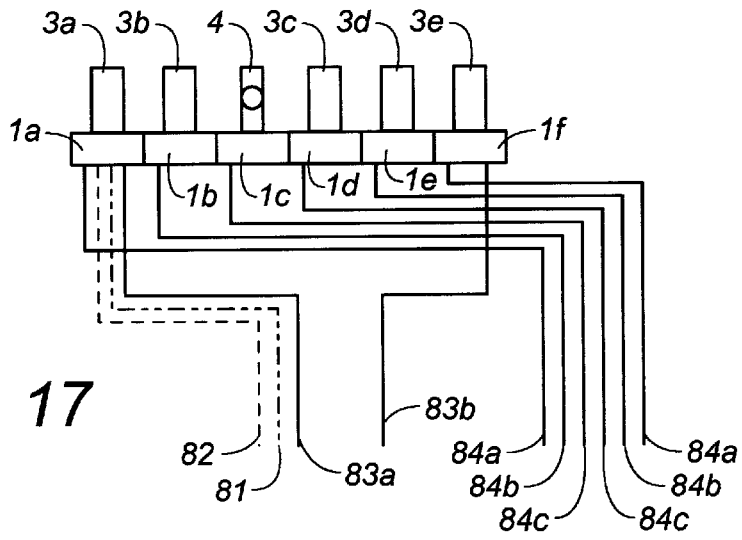
FIG. 17 and FIG. 18 are schematic views of the feeding pipeline network of a dispensing line carried out according to the present invention.
Figure 18:
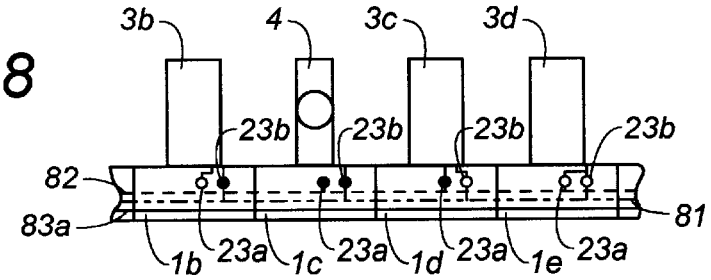
Figure 19:
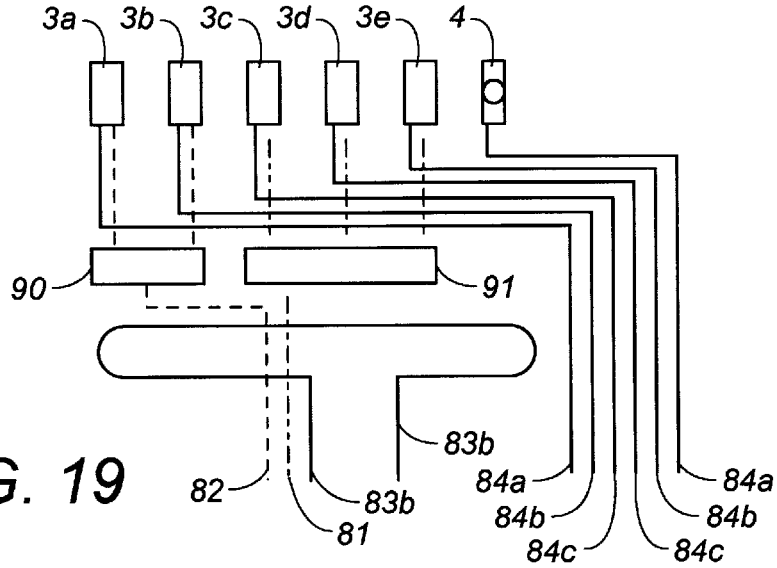
FIG. 19 shows schematically the feeding pipeline network of a dispensing line carried out according to the state of the art.

The single unit can be used for post-mix non carbonated beverages or for post-mix carbonated beverages with the possibility of relating the dilution of the carbon dioxide inside the water using the regulating means 23*a* and 23*b*. As it is shown in FIG. 17 only the modular unit 1*a*, positioned at one terminal side part of the set of units, is connected directly to the cooling apparatus for the supplying of still water, through the pipeline 81 and for the carbonated water through the pipeline 82. The modular unit 1*a* is further fed with blow-by water through the pipeline 83*a*, water which is carried back to the cooling coils through the pipeline 83*b* connected to the modular unit if placed at the other terminal side part of the set. The intermediate modular units 1*b*, 1*c*, 1*d* and 1*e* are fed with the still water, carbonated water and refrigerating water through the longitudinal channels 14, 15 and 16 which are connected between the modular adjacent units, whereas each unit is fed directly with the respective pre-mix or post-mix beverages through the channels 84*a*, 84*b*, 84*c*, 84*d*, 84*e* and 84*f*. In FIG. 17 it is schematically shown a dispensing front part constituted by five post-mix taps 3*a*, 3*b*, 3*c*, 3*d* and 3*f* and by the pre-mix tap 4, using the means 23*a* and 23*b* it is determined the opening or the closing of the longitudinal channels 15 and 16. As schematically shown in FIG. 18, the taps 3*b*, 3*c* and 3*d* are in such a way post-mix taps with still water, with carbonated water and with diluted carbonated water and the tap 4 is a pre-mix tap mounted directly on a modular unit in which the channels 15 and 16 have been closed. The same dispensing front part is shown in FIG. 19 wherein the elements 90 and 91 are the units obtained according to the state of art. The unit 90 supplies the post-mix taps 3*a* and 3*b* with still water coming from the pipeline 81. The unit 91 supplies the post-mix taps 3*c*, 3*d* and 3*e* with carbonated water coming from the pipeline 82. The cooling system is outside the units and the blow-up is obtained through the pipelines 83*a* and 83*b*. The beverages arrive to each tap coming from the pipelines 84*a*, 84*b*, 84*c*, 84*d*, 84*e* and 84 *f*. The pre-mix tap 4 is mounted on a supporting member (not shown in figure) different from said units because it does not need dilution water.

The modular units carried out according to the present invention allow mounting the post-mix taps directly on the single units through the holes 58*a*, 58*b*, 58*c* and 58*d* without the necessity of inserting intermediate valve bases having the aim to allow the interruption of the inflow of still or carbonated water and of the syrup when the taps are dismounted. The presence of the regulating means 23*a* and 23*b* and the gate valves 65*a* and 65*b* allow the same unit to carry out such operation. In case of maintenance service it is possible to remove and substitute the single modular unit as shown in FIG. 1 and FIG. 1*a* without being forced to dismount the adjacent units, because the simple connection system is based upon the joint connection, which furthermore prevents the use of possible intermediate joints increasing the sealing of the whole dispensing front part.

The present invention is suitable to variations and changing all belonging to the same inventive concept, furthermore all the details can be substituted with other technically equivalent elements.

What is claimed is:

1. Modular manifold system for the distribution of pre-mix and post-mix beverages, having pipelines coming from a cooling system and carrying beverages, carring still water and carbonated water with which the post-mix beverages will be diluted, and the fluid used for the cooling of the system, comprising at least two modular units connected to each other, wherein inside each unit two transversal channels are suitable for transporting pre-mix beverages and syrups for post-mix beverages, said channels being outside communicating in order to be connected to outside feeding and dispensing devices, each of said units comprising three longitudinal channels suitable for transporting water carbonated water and refrigerating fluid, said channels of adjacent units communicating with each other devices, each of said units further comprising three transversal channels outletting on said three longitudinal channels and outside communicating in order to be connected to outside feeding device. Each of said units also comprising regulating means which allow water and carbonated water, dilutes the syrup and regulates inflow of the two types of water to a mixing chamber positioned inside the unit and communicating outside through suitable channels, each unit further being provided with gate valves which allow the opening and the closing of channels suitable for transporting pre-mix beverages and syrups.

2. Modular manifold system according to claim 1 characterized by the fact that only the two units placed at the terminal side parts of the system are connected to said outside feeding devices of the water, of carbonated water and the cooling fluid, whereas the intermediate units have said three transversal channels outletting on said three longitudinal channels closed through suitable cap elements.

3. Modular manifold system according to claim 1 wherein the connection among adjacent units is obtained engaging the faying surfaces between the same units in order to complement in such a way that an engaging coupling without intermediate joints, said connection is furthermore allowed by suitable fastening means.

4. Modular manifold system according to claim 3 said fastening means comprise passing pins working as connectors, said passing pins being L-shaped to facilitate the grip.

5. Modular manifold system according to claim 1 characterized by the fact that the channels fit for being passed by the pre-mix beverages and syrups are orthogonal to a direction of possible connection between adjacent units and they completely the unit according to such direction.

6. Modular manifold system according to claim 1 characterized by the fact that the channels fit for being passed pre-mix beverages and by the syrups in sets of two comprise cylindrical portions having circular section.

7. Modular manifold system according to claim 1, wherein said longitudinal channels suitable for transporting water, water and blow-by water in set of three comprise cylindrical portions having a circular section.

8. Modular manifold system according to claim 1, wherein said regulating means for selecting which water dilutes the syrup and regulating inflow of the two types of water in the mixing chamber operate nonreturn valves to which control means are connected said valves and control means are housed in cylindrical chambers inside which they can axially move.

9. Modular manifold system according to the claim 8, wherein said control means comprise cylindrical parts facing an external surface of the unit presenting corresponding to such terminal part at least one groove through which it is possible to modify the axial position of said control means and of the corresponding nonreturn valves.

10. Modular manifold system according to claim 1, wherein said gate valves comprise cylindrical parts facing outside the unit, they are housed inside cylindrical chambers carried out in the unit and in which the gate valves can move axially, said gate valves further presenting at least one groove on the surface facing outside through which it is possible to modify the position of the same in the cylindrical chamber.

11. Modular manifold system according to claim 1, wherein a single unit can be used to feed indifferently only one post-mix tap with water or only one post-mix tap with carbonated water or only one pre-mix tap or to feed two post-mix taps with water or two post-mix taps with carbonated water, all that being possible suitably positioning said gate valves and said regulating means.

12. Modular manifold system according to claim 1, wherein the dispensing taps are directly connected to the unit having said gate valves and said regulating mean, having the aim of interrupting the inflow of water and/or beverages to the taps in case they are dismounted or are since a long time in non-use condition.

13. Modular manifold system according to claim 1, herein a shape of the dispensing front part to supply is independent.

14. Modular manifold system according to claim 1, wherein it is possible to remove for the maintenance only one intermediate unit without operating on the adjacent units.

* * * * *